US005778479A

United States Patent [19]

Raia

[11] Patent Number: 5,778,479

[45] Date of Patent: Jul. 14, 1998

[54] MODULAR, MULTIPLE PAINT BRUSH SYSTEM

[76] Inventor: Lawrence A. Raia, 19 Denison Dr. East, Post Office of Saddle River, N.J. 07458

[21] Appl. No.: 703,658

[22] Filed: Aug. 27, 1996

[51] Int. Cl.[6] ..... A46B 15/00

[52] U.S. Cl. ..... 15/202; 15/176.2; 300/21

[58] Field of Search ..... 15/176.1, 176.2, 15/194, 201, 202; 29/451; 300/21

[56] References Cited

U.S. PATENT DOCUMENTS

| | | | |
|---|---|---|---|
| 805,431 | 11/1905 | Fetters | 15/202 |
| 2,384,029 | 9/1945 | Hawkins | 15/201 |
| 2,629,125 | 2/1953 | Ferguson | 15/202 |
| 2,677,841 | 5/1954 | Tetzlaff | 15/202 |
| 4,025,980 | 5/1977 | Neil | 15/202 |

FOREIGN PATENT DOCUMENTS

| | | | |
|---|---|---|---|
| 237077 | 7/1925 | United Kingdom | 15/202 |

*Primary Examiner*—Terrence Till
*Attorney, Agent, or Firm*—Stephen W. White

[57] ABSTRACT

A modular paint brush which comprises two or more brush units which are comprised of a upper section and a bottom brush section, each upper section having a top, a front, a back parallel to said front and two parallel sides with dovetail connections attached thereto. Each brush unit is matably connected to another using a series of tapered dovetail connections which insures complete contact and fit of one unit to the next. This complete contact of brush unit to brush unit insures that paint can be applied evenly and over the desired surface without streaking, for example. A handle is connected to one of the tops of one of the brush units proximate to the center of the modular paint brush.

10 Claims, 2 Drawing Sheets

FIG. 1
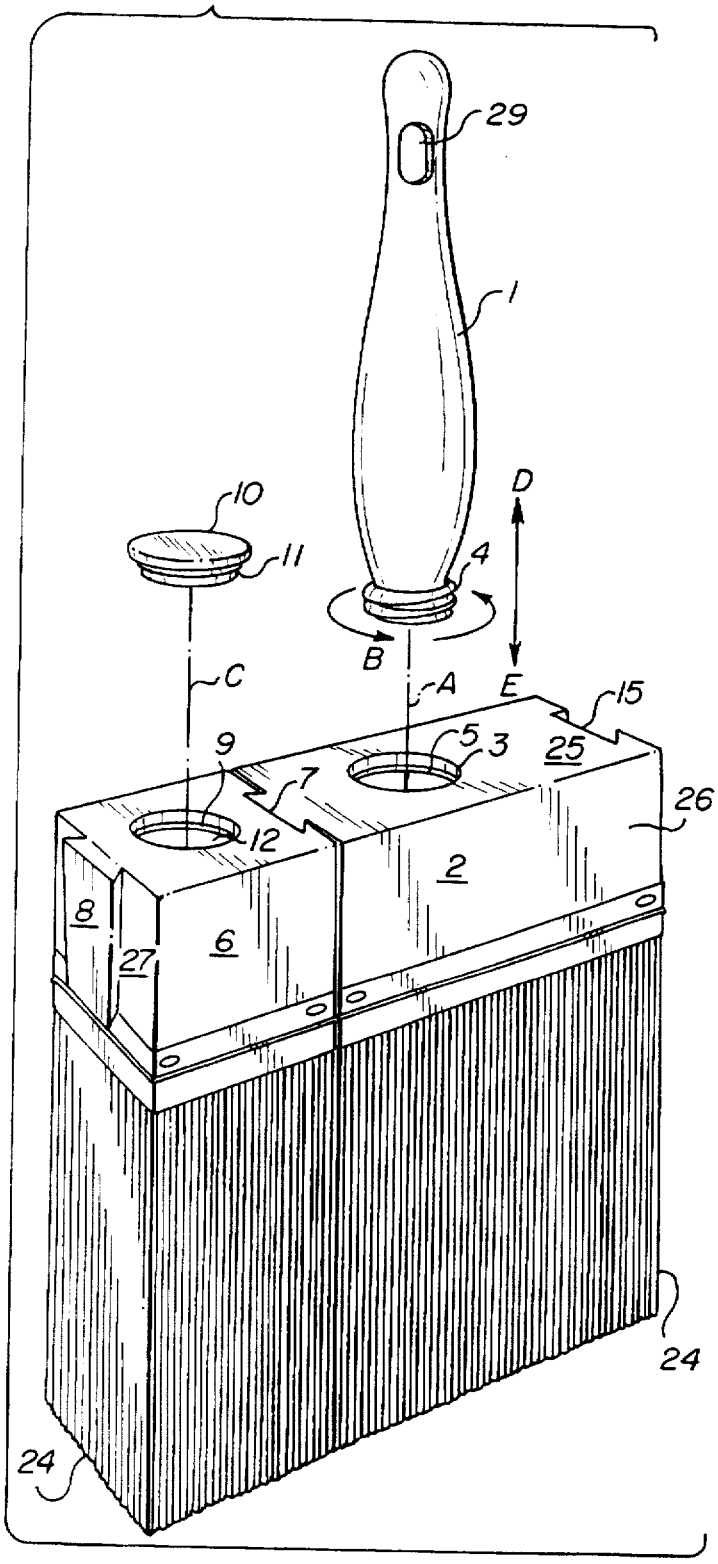
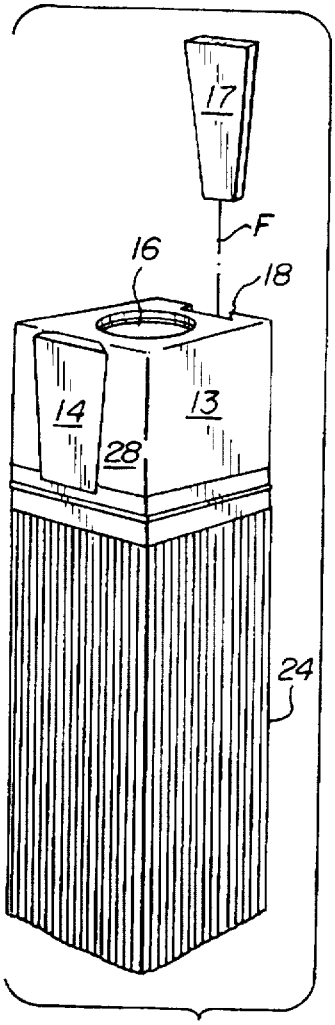
FIG. 2

MODULAR, MULTIPLE PAINT BRUSH SYSTEM

BACKGROUND OF THE INVENTION

1. Field of the Invention

This invention relates to the field of paint brushes and specifically to the field of paint brush systems. More specifically, this invention relates to the field of modular paint brush systems wherein said paint brushes comprise a multiplicity of interconnected brush elements of varying widths. Even more specifically, this invention relates to modular paint brush systems having interconnected brush units with varying widths that can be easily connected and disconnected as needed for painting.

2. Description of the Prior Art

There are a number of paint brush elements described in the prior art. Some of these elements are described as being comprised of detachable brush sections or elements of varying widths so that one can add or detract brush sections or elements to add or detract for overall brush size and the ability to paint in any particular venue. Many of these detachable prior art brush elements include a plurality of other elements which seem to complicate the desired use. For example, one such prior art element requires that a plurality of plugs and inserts be used to interconnect brushes of varying sizes. This element is extremely complicated and is difficult to operate especially when the brushes are covered with paint.

Still other prior art elements describe a universal handle into which brush elements are screwed adding more or less brushes as desired. This element too is fairly complicated and hard to use especially when covered in paint.

Other prior art elements using screws, clamp extensions, etc., all to add or remove sections of paint brushes are also described. These too have many expensive and hard to use parts.

Although these prior art elements do indeed achieve painting brushes of varying widths, as desired, most of these elements have several undesirable parts that make them difficult to use and adjust as desired. Additionally, these prior art elements are not modular in nature and connections made between various sections thereof are not firm and when used to paint will produce uneven, streaky and poor painting results. Thus, none of the prior art elements have found wide use within the painting industry.

SUMMARY OF THE INVENTION

There is a pressing need within the painting industry to provide a utile modular painting system that can use a multiplicity of brushes of varying widths adding to or detracting to the brush system in order to adjust the painting width thereof. Thus, it is an object of this invention to provide a single paint brush to which modular brush elements of varying sizes can be added or removed therefrom in order to meet any required brush size. It is yet another object of this invention to provide paint brushes to which modular brush elements of varying sizes can be added to conveniently even if paint is already on the surface or surrounding said brush. It is also an object of this invention to provide paint brushes to which modular brush elements of varying sizes can be added in incremental sizes. These and yet other objects are achieved A modular paint brush said paint brush comprising at least two brush units of varying brush widths, each of said brush units comprising an upper, mounting section and a lower, brush section, said upper, mounting section comprising a top, a front, a back parallel to said front, and two parallel sides, a handle connectably mated to one of said tops, one of said parallel sides of each brush section having a female part of a dovetail connection mounted thereon, wherein said female dovetail connection is tapered to insure tight fit, and the other of said parallel sides of each having a male part of a dovetail connection mounted thereon, wherein said male dovetail connection is tapered to fit tightly when connected to said female dovetail connection, wherein said brush units are connectably mated by insertion of said male dovetail part on one of said brush unit to said female dovetail part of another of said brush units thereby forming a modular brush made of said connected brush units.

BRIEF DESCRIPTION OF THE DRAWINGS

FIG. 1 is an exploded perspective view of a modular paint brush system of this invention wherein two brush units are mated by dovetail connections.

FIG. 2 is a closeup view of a single brush unit of this invention to show the detail of the dovetail connection points.

DETAILS OF THE INVENTION

Figure 3:
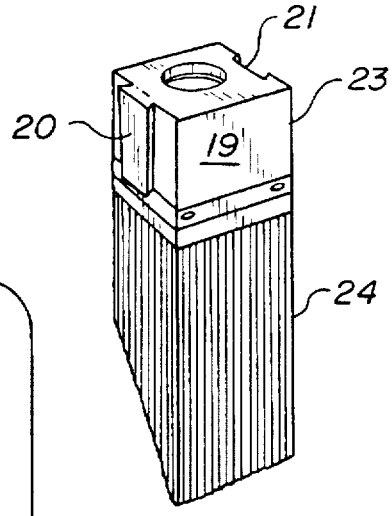
FIG. 3 is a view of a single brush unit of this invention modified to provide edge-type painting.

Referring now specifically to the drawings, which represent the essence of this invention, but which the invention is not specifically limited, FIG. 1 is a closeup view, partially exploded perspective view of a modular paint brush system of this invention. In this particular view, 1 is a handle element designed to be connected to one of the paint brush units 2 along a line represented by arrow A. The handle element 1 would, in this particular showing, be joined to paint brush unit 2 by screwing into hole 3 located in the top, mounting section 25 of the paint brush unit 2. Also shown on the handle is a hole 29 to permit the hanging of the modular brush during drying, for example. The top, mounting section 25 also comprises a front 26 and parallel to this front, a back (not seen in this view). Two parallel sides, also not seen in this view, are designed to hold parts of a dovetail connection means described later.

Continuing on in FIG. 1, a series of threads is shown as 4, on handle element 1, and 5 in hole 3 to make this joining. The joining, in this particular figure, would follow a direction shown by arrow B. Paint brush unit 2 is connectably mated to paint brush unit 6 by a dovetail connection the top of which is shown at 7. These dovetail connection parts, which comprise male and female parts, are located on parallel sides of the top section, neither of which can be fully seen in this view. A male part is shown on brush unit 6 at 8 and one of the parallel sides of the top section of brush unit 6 can be seen at 27. When another brush unit is to be connected, a female part would connect thereto. Another hole is shown as 9 on brush unit 6. A covering plug 10 would then fit into hole 9 in order to cover the hole during painting. This hole could also be used for a brush handle as described previously. Once again, the hole 9 and the plug 10 have threads shown as 11 and 12 respectively and the plug 10 is inserted into hole 9 in the direction shown along arrow C.

FIG. 2 shows yet another brush unit 13 ready to be matably connected to the main brush units with a male part 14 located on parallel side 28. To connect this new brush unit 13 to brush unit 2 one simply raises brush unit 13 up and down along the path shown by arrows D–E and into the female part 15 on brush unit 2. Another hole 16 is shown on the top of brush unit 13 ready to accept either a brush handle or a plug. Within FIG. 2, a dovetail cover or insert is shown as 17. This can be added to insure that the female part 18 on brush unit 13 is covered if no further brush units are to be added prior to painting. This covering of the female part of the dovetail connection insures that paint does not become entrapped therein. The dovetail cover (which in essence is simply a male part thereof) is pushed into the female part along the arrow F. Thus, if one combines the showing of FIGS. 1 and 2, a brush comprising three, separate units is achievable. Alternatively, a brush comprising one, two or three units may be encompassed.

FIG. 3 is a showing of a particular brush unit 19 which may be used for a particular purpose such as edging. This unit too contains male 20 and female 21 parts of a dovetail-type connection, with these parts being located on parallel sides of the top 23 of the brush unit 19. In all cases, the bottom of the brush units shown in these FIGS. (2, 6, 13 and 19) there are bristles 24. These bristles may be of any known material and length and width and not necessarily limited to those shown in these drawings.

Figure 4:
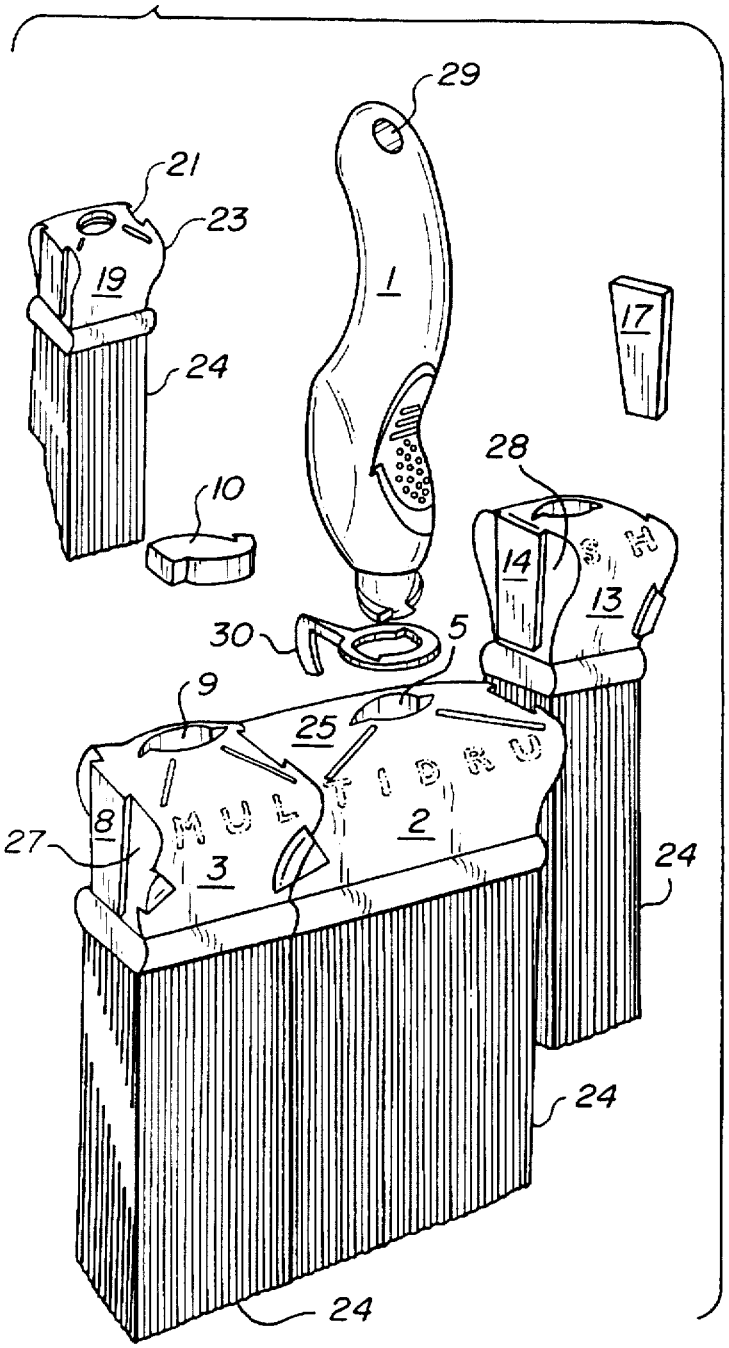
FIG. 4 is an alternative showing of the elements contained within FIGS. 1–3.

FIG. 4 is an alternative showing of the modular paint brush system shown in FIGS. 1–3. The elements in this figure are the same as those contained within the preceding figures with some changes. For example, the handle 1 has been curved to better fit the human hand. The insertion method of the handle 1 into holes contained within the various units have a quick connecting twist lock system or method as shown herein. In addition, the brush shown in this figure has a holding element 30 which can be inserted between the handle 1 and the top mounting section 25. This holding element can be used to hold the paint brush in a can of paint, for example. The brush of FIG. 4 is shown with writing on the upper portion of the brush, for example. This writing might be useful in helping one to add section to section in a correct manner.

Each of the brush units does encompass a top and bottom portions, with the top portion designed to hold the units together with dovetail connections and the handle. In addition, the top portion will hold the bristles which comprise the bottom portion of the brush unit. The top portion may be made from conventional materials well-known within the painting industry, such as wood, plastic, etc. The use of an ABS type plastic is preferred since the mating of section to section would have the strongest connection. It is important that the top portion be of such a shape as to permit easy and fast connections when mated to another brush unit. The bristle or bottom portion may also comprise various materials as is well-known. These bristles may be made from natural or man-made materials and are selected for the painting purpose and the paint used.

Dovetail connections are also well-known in the prior art. As mentioned previously, these connections usually comprise a male and female part that are tapered to fit. This tapering of the dovetail connection is important since the fit of section to section must be extremely tight. Thus, when the male part is inserted firmly into the female part, the connection will join the brush units together in a like and firm manner. This is important since when so joined, the individual brush units will appear to be as one brush and will not leave streaks and the like while painting. I feel that this is a distinct advantage over the prior art painting instruments which do not employ dovetail connections. The prior art painting instruments have either screw-in connections or employ a plug connection and this will not insure that the brushes line up properly. Thus, these prior art painting instruments will leave streaks and gaps in the painting and have not been well-received by the painting industry.

The size of the brush units can be selected to form a multiple, final brush size as desired. In the drawings which only represent one embodiment of this invention, I show three separate sizes within FIGS. 1 and 2. These may be represented as 1" (brush unit 13), 1½" (brush unit 6) and 2" (brush unit 2). This combination permits seven (7) different brush sizes to be achieved within the ambit of my invention. The element represented by brush unit 19 is a specialty unit used for edge painting, for example. In order to perform within the best mode, I envision brush units that increase in increments of ½". This particular size is most propitious since it permits easy size increase or decrease and easy connections using the dovetail-type connection as previously described.

Each of the brush units should have a threaded hole to permit access by a handle. This embodiment will permit the use of a single handle to cover a wide range of brush sizes and will also permit the use of a single brush unit. The threaded holes, or twist lock connection methods, present within these brush units may be off-set in some of the brush units in order to permit the handle to be centered when a multiplicity of brush units are matably connected by dovetail connections. The size and position of the off-set is a variable depending on the size of the modular brush being used. I can use a particular formula as follows:

$$[\text{modular brush width (in inches)} \times 0.25] - 0.125 = \text{offset}$$

For example, for a 2" brush unit we get the following:

$$[2'' \times 0.25] - 0.125 = 0.375$$

which would represent an approximate ⅜ths inch off-set. This particular off-set centers the handle when two or more sections are connected as shown in FIGS. 1 and 2. Additionally, this off-set, when used with a single brush unit, will fit a more natural grip and follows standard painting techniques. When two brush units are combined within this invention it is handy to insure that the smaller unit is connected to the larger unit on the left side, when viewed from the front.

Graphic designs may be employed on the top portion of each brush unit to designate a brush front and to insure connections are properly made and to guide the user when making the various connections. Other markings to insure such connections may also be used within the ambit of my invention. In addition, these designs may be used to decorate and define the unique modular brush system of my invention over the prior art elements.

To minimize cleaning of each of the brush units, I show a plug element which may be inserted within the holes when the holes are not used to contain a handle element. These plugs may be made from conventional materials such as wood, plastic, rubber, metal and the like. When used to close the hole, paint will not enter in the hole. This makes cleaning easier.

Another cover or insert to cover up unused portions of the dovetail element may also be used in order to help in the clean-up of paint from my unique, modular brush element. I show such an element as 17 in FIG. 2. The material of construction for this element may also be any of the conventional materials well-known in the prior art, such as wood, metal, rubber, plastic and the like.

As previously mentioned, the brush portion of my brush units may be made from any conventional materials including natural (e.g. pig bristles, horse hair, etc.) or man-made materials (e.g. nylons and the like, for example). These brush elements are identical to any prior art elements. One particular mode would include tapered brushes that can be used as an edging brush, for example.

It is important that the brush units that contain dovetail connections be formed in such a way that the brushes line up securely when mated in a manner taught within this invention. If the brush units are so matably connected, there will be no gaps that can produce uneven painting, for example.

Other embodiments within the metes and bounds of my invention should be apparent from reading the specification along with the drawings attached hereto.

I claim:

1. A modular paint brush said paint brush comprising at least two brush units of varying brush widths, each of said brush units comprising an upper mounting section and a lower, brush section, said upper mounting section comprising a top, a front, a back parallel to said front, and two parallel sides, a handle connectably mated to one of said tops, one of said parallel sides of each section having a female part of a dovetail connection mounted thereon, wherein said female dovetail connection is tapered, and the other of said parallel sides of each having a male part of a dovetail connection mounted thereon, wherein said male dovetail connection is tapered to insure a tight fit when connected to said female dovetail connection, wherein said brush units are connectably mated by insertion of said male dovetail part on one of said brush unit to said female dovetail part of another of said brush units thereby forming a modular brush made of said connected brush units.

2. The modular paint brush of claim 1 wherein said handle is connectably mated in said upper, mounting section by means of a threads on said handle and a threaded hole located in the top of said mounting section.

3. The modular paint brush of claim 2 wherein a holding element is inserted between said handle and said upper mounting section, wherein said holding element will hold said paint brush when said paint brush is placed within a paint can.

4. The modular paint brush of claim 1 wherein said handle is connectably mated in said upper, mounting section by means of a twist lock quick connection on said handle and a twist lock hole located in the top of said mounting section.

5. The modular paint brush of claim 1 wherein three brush units of varying brush widths are matably connected and said handle is located in a mounting section of one of said brush units in a location which proximates the center of said modular paint brush.

6. The modular paint brush of claim 1 wherein each of said fronts of each of said brush units is marked so as to indicate a matable connection point for each of said dovetail connections.

7. A method for forming a modular paint brush, said modular paint brush comprising at least two brush units of varying widths, each of said brush units comprising an upper, mounting section and a lower, brush section, said upper mounting section comprising a top, a front, a back parallel to said front, and two parallel sides, and a handle, one of said parallel sides of each brush section having a female part of a dovetail connection mounted thereon and the other of said parallel sides of each having a male part of a dovetail connection mounted thereon, comprising the steps of:

a. connectably mating each of said brush units by joining said dovetail connections; and, b. installing said handle in one of said tops of one of said brush units at a location which proximates a center of said modular paint brush when all of said brush units are matably connected.

8. A method according to claim 7 wherein there are three brush units of varying widths and said handle is installed in said top using a threaded hold contained therein.

9. A method according to claim 7 wherein said proximate center of said modular paint brush is calculated by the formula:

$$\text{proximate center}=[\text{modular paint brush width (in inches)}\times 0.125].$$

10. A method according to claim 7 wherein each of said brush units contains markings applied to each of said front so as to indicate a direction for connectably mating each of said brush units by dovetail connection to form said modular paint brush.

* * * * *